US005760690A

United States Patent [19]

French

[11] Patent Number: 5,760,690

[45] Date of Patent: Jun. 2, 1998

[54] PORTABLE COMPUTER WITH INTEGRATED ALARM SYSTEM

[75] Inventor: Roger Allan French, Londonderry, N.H.

[73] Assignee: Digital Equipment Corporation, Maynard, Mass.

[21] Appl. No.: 641,793

[22] Filed: May 2, 1996

[51] Int. Cl.[6] ..... G08B 13/14

[52] U.S. Cl. ..... 340/571; 340/568; 395/2.82

[58] Field of Search ..... 340/571, 568, 340/825.31, 565; 395/2.79, 2.82

[56] References Cited

U.S. PATENT DOCUMENTS

| | | | |
|---|---|---|---|
| 4,117,468 | 9/1978 | Vasquez | 340/571 |
| 4,284,983 | 8/1981 | Lent | 340/568 |
| 4,494,114 | 1/1985 | Kaish | 340/825.31 |
| 4,686,514 | 8/1987 | Liptak, Jr. et al. | 340/571 |
| 4,908,608 | 3/1990 | Reinke et al. | 340/571 |
| 4,985,695 | 1/1991 | Wilkinson et al. | 340/571 |
| 5,317,304 | 5/1994 | Choi | 340/571 |
| 5,406,261 | 4/1995 | Glenn | 340/571 |
| 5,481,645 | 1/1996 | Bertino et al. | 395/2.79 |
| 5,515,032 | 5/1996 | Johnson | 340/571 |
| 5,574,429 | 11/1996 | Streeter | 340/571 |
| 5,578,991 | 11/1996 | Scholder | 340/571 |

OTHER PUBLICATIONS

"PowerBook: Armed and dangerous", MACWEEK, Jan. 9, 1995, p. 16.

"Third parties hard at work to keep PBs at hand", MACWEEK, Nov. 16, 1992, p. 20.

*Primary Examiner*—Jeffery Hofsass
*Assistant Examiner*—Benjamin C. Lee
*Attorney, Agent, or Firm*—David A. Dagg

[57] ABSTRACT

A portable computer is provided with an integrated alarm system. When armed, the alarm system provides for the sounding of an alarm and/or disabling of the computer upon unauthorized movement of the computer from a stationary position.

30 Claims, 3 Drawing Sheets

PORTABLE COMPUTER WITH INTEGRATED ALARM SYSTEM

BACKGROUND OF THE INVENTION

This invention relates generally to computer systems and more particularly to security devices for portable or laptop computers.

As is generally known in the art, laptop or notebook computers are typically small lightweight systems which have the full functionality of a full size computer system. A driving force in the design of laptop and notebook computers is the goal to make them both smaller and lighter, thus easier to transport. As laptops and notebook computers are made smaller and lighter, they are also made easier to conceal. The fact that these computers are easy to transport and conceal leads to an increase in the amount of theft of such systems.

Laptop and notebook computers are generally stolen by people who may see one lying unattended and simply pick it up and place it in their briefcase. Some may even pick one up and walk away with it. As a result, both display models, (e.g., those placed on display in stores which sell laptop and notebook computers), and computers owned personally by individuals, are being taken at an alarming rate.

Modern laptop and notebook computers have no built in deterrence or warning system in order to deter theft. Some solutions which have been provided in order to deter the amount of theft of laptop computers include devices which allow the small computers to be anchored to a desk top or a work surface. Although this may work for systems on display in a computer store, this does not provide an adequate solution for those who are continually travelling and need to take full advantage of the mobility of such a small computing system. That is, a security system which require the user to bolt or cable the system to each desk or chair that they might work at in the course of travelling does not provide an adequate and convenient security solution. Others have tried solutions which included attaching, via tape, velcro or some other type of fastener, some sort of alarm system to the laptop computer. However, these systems suffer from the drawback that they can easily be removed and thus greatly diminishing their effectiveness. In addition, these systems do not provide the ability to secure the data stored on the computer in the event the alarm is defeated. Since the value of the portable computer may pale in comparison to the costs associated with the loss or misappropriation of the data stored therein, present alarm systems do not protect provide complete security.

It would be advantageous, therefore to provide a laptop or notebook type computer system which has a built-in security device which could be armed or disarmed by the user without having to secure the portable computer to a work surface.

SUMMARY OF THE INVENTION

In accordance with the present invention, a portable computer system includes an integrated alarm system. The alarm system includes one or more motion sensors and/or microswitches for providing a motion signal indicating that the portable computer is being moved from a stationary position or that the computer is being opened from its closed position. The alarm further includes a control circuit which is responsive to the motion signal for providing a siren signal to a speaker or siren. The siren is responsive to the siren signal for producing an audible tone. Also included in the alarm system is an interface coupled to the control circuit for enabling and disabling said alarm system. The alarm system also includes indicator LEDs for indicating various states of the alarm system. With such an arrangement, theft of a portable computer can be prevented without the need for fastening it to a surface with mechanical means. Furthermore by integrating the alarm into the computer system, defeating the alarm by a would-be thief is avoided.

In accordance with another aspect of the present invention a portable computer system includes an integrated alarm as described above. In addition to providing for the sounding of an alarm upon unauthorized tampering, the alarm system includes a system disabling circuit. Upon detection of unauthorized use, the computer system is disabled functionally until the proper keycode is entered via a keypad interface. With such an arrangement a portable computer system is rendered useless to a would-be thief and thus less likely to be stolen. Furthermore with such a system the data and programs stored on a computer system employing such an alarm is protected from unauthorized access by a thief who may manage to make off with the system or attempts to access the system without moving it.

BRIEF DESCRIPTION OF THE DRAWINGS

The above, and further advantages of this invention may be better understood by referring to the following description taken in conjunction with the accompanying drawings in which.

DETAILED DESCRIPTION OF THE PREFERRED EMBODIMENT

Figure 1A:
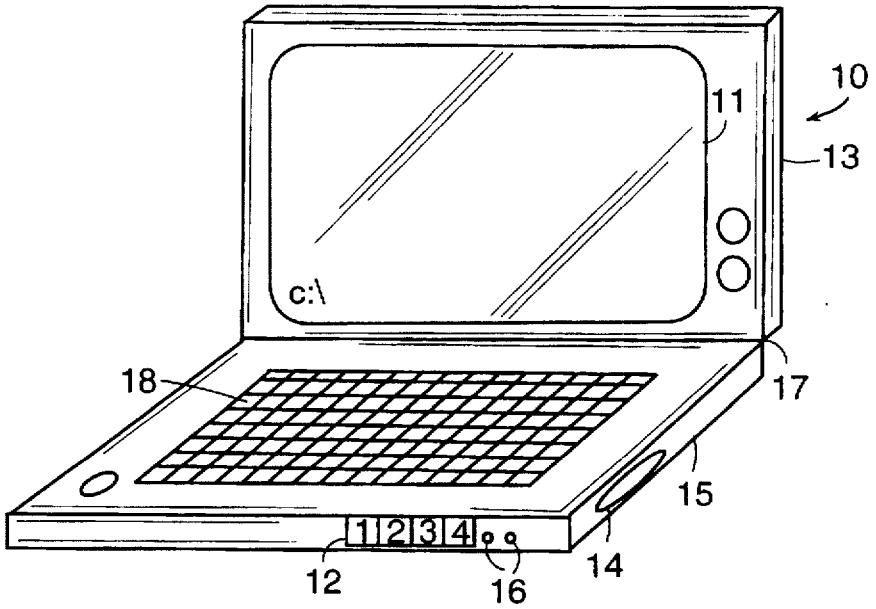
FIG. 1*a* is a diagram of a notebook style computer in the open position.

Referring now to FIG 1*a*, a laptop computer 10 is shown in the open position to allow operation of the system by a user. As with most laptop computers, laptop computer 10 includes two cases 13, 15, which are hingeably attached about point 17, such that when the computer is open for use, it appears as shown in FIG 1*a*. and when closed and not in use, it appears as shown in FIG 1*b*.

Each of the cases 13 and 15 include the components of the complete computer system. For example, here case 13 includes the display on which the user views the user interface (e.g. graphical windows, icons, etc). Case 15 includes items such as keyboard 18 which allows the user to make input to the system and interact with those items shown on display 11. According to the present invention, one or both of the case halves, here case 15, of laptop 10 also includes components of an alarm system.

According to the preferred embodiment, the alarm system components include keypad 12, indicators 16 and a speaker or siren 14. As will be discussed in more detail with respect to FIG. 2, the alarm system of the laptop computer shown in FIGS. 1*a* and 1*b* operates to prevent unauthorized removal of the laptop computer 10 by providing a keypad actuated alarm system, which includes (as will be discussed in connection with FIG. 2) various sensors for monitoring whether the system is being moved from a stationary position.

Figure 1B:
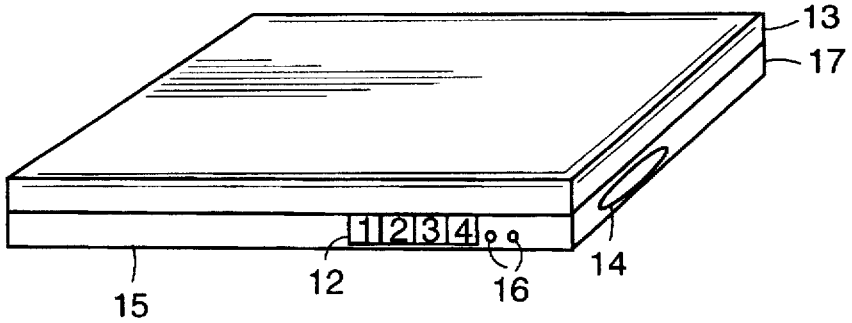
FIG. 1*b* is a diagram of the notebook style computer of FIG. 1*a* shown in the closed position.

As shown in FIG. 1*b*, keypad 12 and indicator 16 are accessible while the laptop is in its folded or closed position. As will be discussed in detail below, this allows the user to finish whatever work is being performing, and then close and power down the system. As will also be discussed in detail below, in addition to sensors for motion, a sensor which detects whether or not the system is opened from the closed position shown in FIG. 1*b*, may also be used as an indicator for activating the alarm. Thus, not only is unauthorized movement of the system as a whole prevented, unauthorized tampering of the system while it remains stationary may also be prevented. Thus, the present invention provides for a completely secure portable computer.

A more detailed description of the alarm system of the present invention will now be discussed with reference to FIG. 2. As shown in the figure, alarm system 20 includes control circuit 22 which is coupled to power supply 26 as well as to speaker/siren 14. In addition, control circuit 22 is coupled to a plurality of sensors 24*a*–24*n*, keypad 12 and LED indicators 16. It should be understood that in order to prevent tampering with the alarm system, all components except for those visible as shown in FIGS. 1*a* and 1*b*, are housed within either or both of the two cases 13 and 15, as shown in FIGS. 1*a* and 1*b*.

According to a preferred embodiment, sensors 24*a*–24*n* may be any of a type widely known in the art. For example, sensor 24*a* may be a motion detection sensor incorporating a mercury switch (not shown). Further, sensor 24*a* may be oriented to detect tilting of the entire laptop computer 10 along one axis. In order to provide a more sensitive and complete alarm system, sensor 24*b* may also be of the type used for sensor 24*a* with the exception that sensor 24*b* be oriented to detect tilting motion along a second perpendicular axis. Alarm system 20 may incorporate any number of sensors as deemed appropriate to detect whether the computer system 10, as shown in FIGS. 1*a* and 1*b*, is being moved from its stationary position. Additional types of sensors may be incorporated. For example, sensor 24*n* may be a microswitch coupled to a latching mechanism (not shown) which secures the two cases 13 and 15 together when laptop computer system 10 is in its closed position (FIG. 1*b*). Thus, when the latch is disengaged, a microswitch contact may be made, activating the alarm, thereby preventing unauthorized opening and inspection of the laptop computer system. The latch sensor also provides a means to arm the alarm system and still provide for authorized transportation of the laptop computer. That is (as described below), the latch sensor could be enabled while the motion sensors are disabled.

Figure 2:
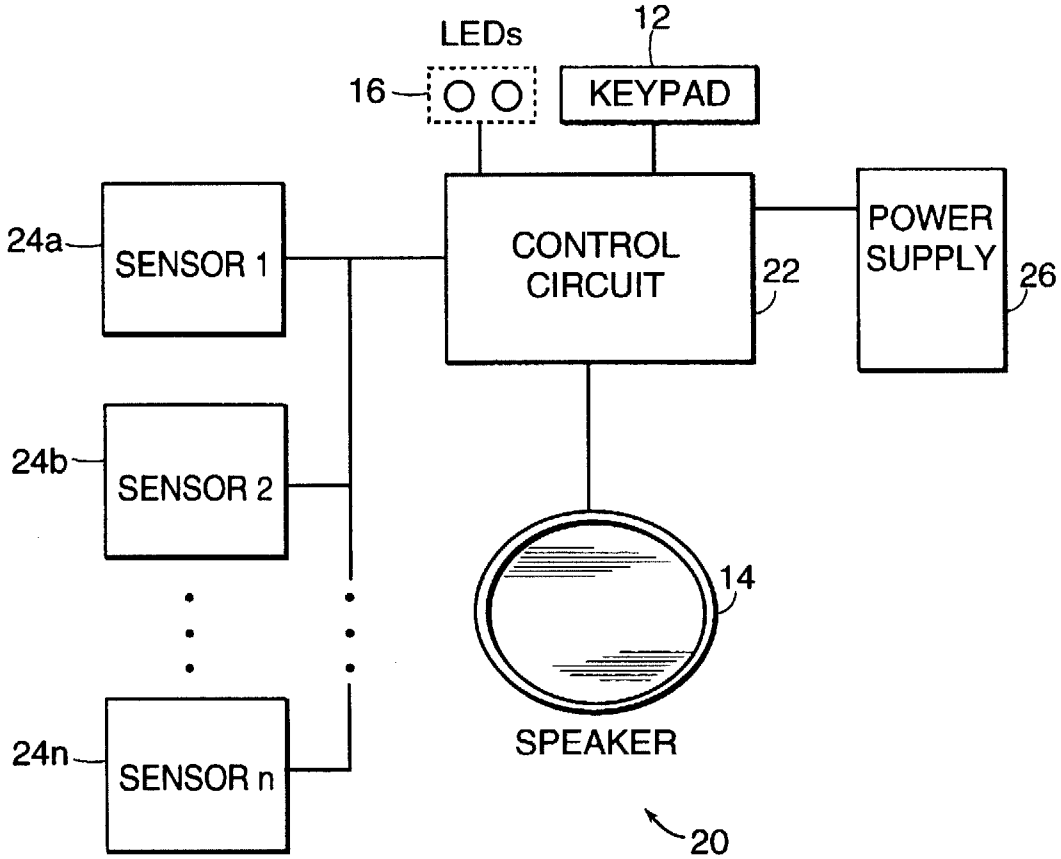
FIG. 2 is a block diagram of the alarm system integrated into the notebook style computer of FIG 1*a;*

Still referring to FIG. 2, keypad 12 and LEDs 16 serve as the user interface to the alarm system. According to a preferred embodiment, keypad 12 may be used to enter a code to arm and disarm alarm system 20. The keypad may also be used to program functionality of the alarm system. For example, pressing certain combinations of keys of keypad 12 may arm various sensors of the system while disarming other sensors of the system. A second keypad combination may cause all of the sensors of the system to be armed, and yet another keypad combination may disarming the entire alarm system. It should be noted that although FIGS. 1*a* and 1*b* show keypad 12 having four independent keys 1–4, this is not meant to be a limitation of the present invention. The number of keys incorporated into the keypad of alarm system 20 is only limited by the intended use of alarm system 20 and the amount of space available for its placement on computer 10.

According to the preferred embodiment, LEDs 16 of alarm system 20 are shown to include two LED indicators. However, this should not be seen as a limitation of the present invention. That is, as many or as few LED indicators as required may be used depending on indication requirements and again, depending upon the space available on a computer system 10. Here the LEDs 16 may be used to indicate whether the alarm is set, whether the alarm is reset, whether the alarm is in a so-called program mode, and further may be used to indicate whether the power supply 26 is still providing adequate power to the alarm system. Other indications may also be provided by providing different colors of LEDs 16. The indications listed above are provided for illustration purpose only and should not be seen as limiting the scope of the present invention.

According to the preferred embodiment, alarm system 20 includes power supply 26. Power supply 26 provides all necessary operating voltages and currents to alarm system 20. Preferably, power supply 26 is separate from the removable rechargeable battery typically associated with portable computers. This would prevent a would be thief from simply removing the rechargeable battery from the system in order to defeat alarm system 20. Again, as noted above, power supply 26 should preferably be placed within one of the cases 13 and 15 to prevent tampering by the would be thief.

Speaker/siren 14 of alarm system 20 could be any one of several well known designs, the only constraint being that the speaker fit within one of the cases as shown in FIGS. 1*a* and 1*b*. Note that the speaker placement shown in FIGS. 1*a* and 1*b* is for illustration purposes only. Placement of speaker 14 is only be limited by the space constraints of cases 13 and 15, and the electrical connections required to be made to control circuit 22.

Control circuit 22 provides all functionality in terms of monitoring signals from sensors 24*a*–24*n* and providing signals to LEDs 16 and speaker 14 in response to entries made on keypad 12. Control circuit could be any one of a number of designs consisting of a combination of logic circuits and/or a microprocessor running a simple program. Alternatively, control circuit 22 could employ a combination of logic circuits in addition to input/output from the CPU of the laptop computer. Note that this would require either providing power to the CPU from a separate non-removable battery or alternatively, accepting the risk of a would be thief simply removing the rechargeable battery of the laptop to defeat the alarm.

Preferably, and according to a preferred embodiment, control circuit 22 is a stand alone circuit being fed from power supply 26, which as noted above is separate from the power supply of the laptop in general. Thus, control circuit 22 provides independent monitoring of sensors 24*a*–24*n*. While the alarm is in an active state, as activated through keypad 12, control circuit 22 receives a signal from any of the sensors 24*a*–24*n* whenever the laptop computer 10 is either being moved or has had its cases opened. As a result of the movement of the computer or opening of the cases a signal would be sent to speaker 14 which would cause a high decibel sound output, thereby alerting either the owner or other nearby persons that the laptop computer is being moved or used without authorization. To be an effective deterrent the sound level output from speaker 14 should preferably be above 110 decibels.

It should be noted that the positions of features such as keypad 12, indicator 16, and speaker 14, as shown in FIGS. 1*a* and 1*b*, are merely for illustration purposes only. However, it should also be noted that such placement allows for access to the arming and disarming through keypad 12 of alarm system 20 while the computer system cases 13 and 15 are in a closed position. This positioning also allows for observation of the status indicators 16 while the cases are closed. Furthermore, this arrangement allows for providing an alarm indication tied to the laptop computer cases 13 and 15 being opened without authorization.

Alternatively, if such an alarm were not required, keypad 12 could be replaced by using any one or combination of the keys of the system keypad 18 and the indicator 16 could be replaced by a display on display 11. Furthermore, rather than have a loud sound be emitted from speaker 14, or in combination with a loud sound being emitted from speaker 14, an unauthorized movement of computer 10, as indicated by the setting of any one of sensors **24*a*14 24*n* may also cause the entire functionality of computer system 10 to be disabled until the proper keycode were entered on keypad 12**. Thus, even if a would be thief were to somehow silence the speaker and make off with the computer, the computer system and any sensitive data would be protected from unauthorized viewing and use.

Figure 3:
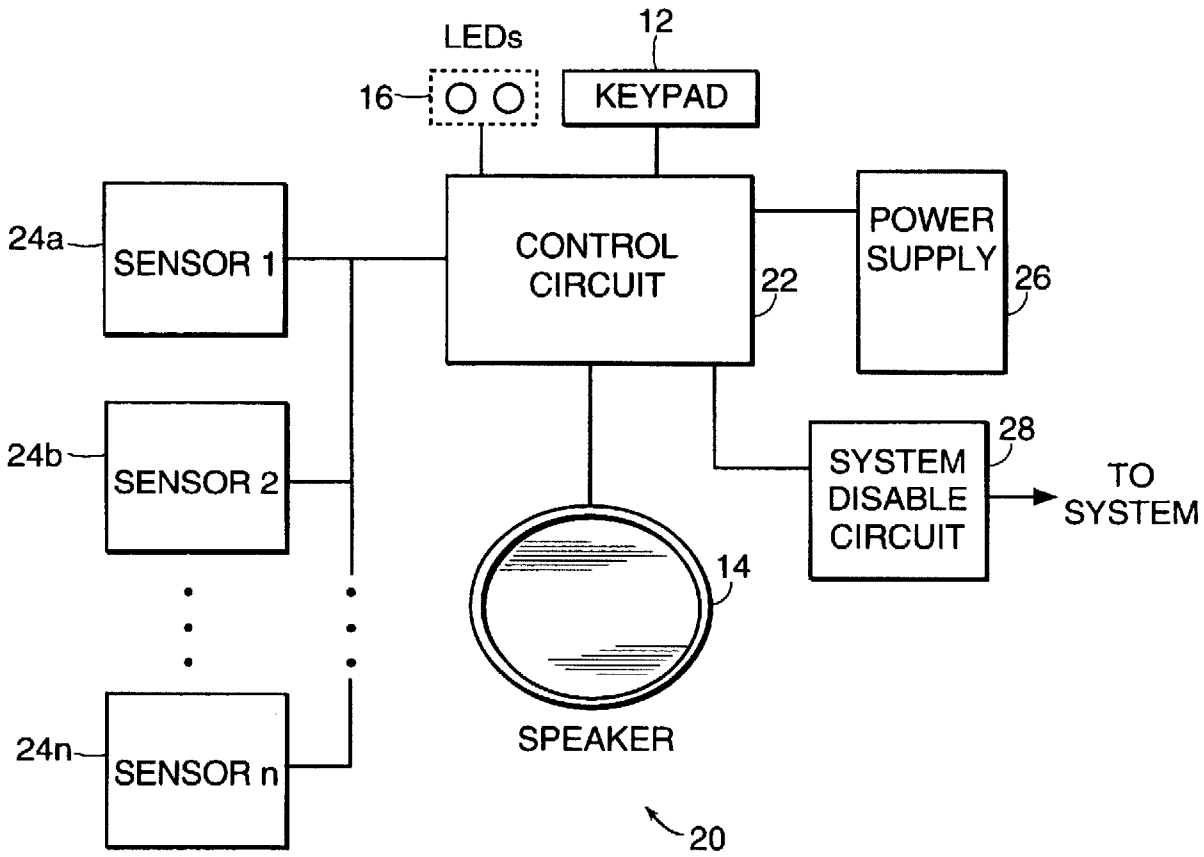
FIG. 3 is a block diagram of an alternate embodiment of the alarm system integrated into the notebook style computer of FIG. 1*a*.

Referring now to FIG. 3, an alternated embodiment of the alarm system 20 of computer system 10 is shown to include, among all the elements as shown in FIG. 2, a system disable circuit 28. As mentioned above, this circuit may be provided in addition to the siren feature in the event of unauthorized tampering with the portable computer. Here illustratively, disable circuit 28 is coupled to the control circuit 22 and is further coupled to the computer system (e.g. CPU). The system disable circuit may provide any number of disabling features. For example, the circuit may be coupled to the CPU reset line (not shown) such that tripping of the alarm (i.e. unauthorized use) causes a signal to be asserted on the reset line until a deactivation code is entered via keypad 12. This would prevent the CPU from operating and thus prevent unauthorized use.

More sophisticated integration may also be accomplished by coupling system disable circuit 28 the computer's system bus (not shown) and thus provide the ability to send commands and data to the CPU in order to place the CPU in a locked (inoperable) mode until the proper code was entered via keypad 12.

Yet another method of preventing unauthorized use may include coupling system disable circuit 28 to the system bus as described above and, in response to tripping of the alarm system, writing data to a non-volatile memory indicating unauthorized use. The computer system may then be designed such that during the boot procedure, the section of non-volatile memory associated with the alarm system is required to be read. If the data stored in the memory indicates tripping of the alarm, the system may be prevented from completing the boot-up procedure until the proper keycode was entered via keypad 12. Since the data would be stored in nonvolatile memory, the alarm system could not be defeated simply by cycling the power to the computer or alarm system. This type of system would render a stolen computer useless to the thief. Combining the disable system with appropriate external markings and warnings would then discourage most would-be thieves.

Having described a preferred embodiment of the invention, it will now become apparent to one of skill in the art that other embodiments incorporating its concepts may be used. It is felt, therefore, that this invention should not be limited to the disclosed embodiment, but rather should be limited only by the spirit and scope of the appending claims.

What is claimed is:

1. A portable computer including an integrated alarm system, comprising:

a first case and a second case hingeably coupled such that said first and second cases may be positioned into one of an opened or a closed position where said open position results from rotating said first and second cases away from each other to reveal a display and controls of said portable computer and where said closed position results from rotating said first and second cases toward each other until said first and second cases are in contact with each other to conceal said display and said controls;

status indicator means, said status indicator means providing an indication as to whether said alarm system is in an enabled state or a disabled state, said indicator means accessible both when said portable computer is in said open position and when said portable computer is in said closed position;

motion sensing means for providing a motion signal indicating that said portable computer is being moved from a stationary position;

control means responsive to said motion signal for providing a siren signal to a siren means, said siren means responsive to said siren signal for producing an audible tone;

interface means coupled to said control means for enabling and disabling said alarm system, said interface means accessible when said portable computer is in both said open and said closed positions, said interface means contained substantially within either of said first or second cases.

2. The portable computer of claim 1 wherein said interface means comprises a keypad having a plurality of keys mounted to either of said first or second cases.

3. The portable computer of claim 1 wherein said indicating means includes at least one light emitting diode mounted to either of said first or second cases.

4. The portable computer of claim 1 wherein said audible tone has a magnitude of approximately 110 decibels.

5. The portable computer of claim 1 wherein said alarm system further includes power supply means, said power supply means providing operating voltages and currents to said sensing means, said control means, said indicating means, and said siren means.

6. The portable computer of claim 5 wherein said power supply means is separate from a power supply used to operate said portable computer.

7. The portable computer of claim 6 wherein said power supply means is the power supply used to operate said portable computer.

8. A portable computer including an integrated alarm system, said alarm system comprising:

motion sensing means for providing a motion signal indicating that said portable computer is being moved from a stationary position;

control means responsive to said motion signal for providing a siren signal to a siren means, said siren means responsive to said siren signal for producing an audible tone;

interface means coupled to said control means for enabling and disabling said alarm system; and disabling means responsive to a disable signal from said control means for disabling operation of said portable computer, said control means asserting said disable signal in response to assertion of said motion signal by said motion sensing means, said disabling means including; means for writing data to a memory, said data to be read by said computer system during a boot procedure such that if said data indicates unauthorized use, said boot procedure is halted thereby rendering said computer system inoperable.

9. The portable computer of claim 8 wherein said interface means provides for the selection of a plurality of operation modes of said alarm system.

10. The portable computer of claim 9 wherein said plurality of operation modes includes said enabling and disabling of said siren means and/or said operation disabling means.

11. A portable computer including an integrated alarm system, comprising:

motion sensing means for providing a motion signal indicating that said portable computer is being moved from a stationary position;

control means responsive to said motion signal for providing a siren signal to a siren means, said siren means responsive to said siren signal for producing an audible tone;

interface means coupled to said control means for enabling and disabling said alarm system; and disabling means responsive to a disable signal from said control means for disabling operation of said portable computer, said control means asserting said disable signal in response to assertion of said motion signal by said motion sensing means, wherein said portable computer includes a central processing unit capable of being placed in a reset state by asserting a signal on a reset terminal of said central processing unit, said disabling means including means for asserting and maintaining said signal on said reset terminal.

12. A portable computer including an integrated alarm system, comprising:

a first case and a second case hingeably coupled such that said first and second cases may be positioned into one of an opened or a closed position where said open position results from rotating said first and second cases away from each other to reveal a display and controls of said portable computer and where said closed position results from rotating said first and second cases toward each other until said first and second cases are in contact with each other to conceal said display and said controls;

at least one motion sensor;

a control circuit coupled to said motion sensor via a motion signal line;

a siren coupled to said control circuit via a siren enable signal line and;

an alarm status indicator coupled to said control circuit, said alarm status indicator providing an indication as to whether said alarm system is in an enabled state or a disabled state, said alarm status indicator accessible both when said portable computer is in said open position and when said portable computer is in said closed position; and a keypad coupled to said control circuit and having at least one key for enabling and disabling said alarm system, wherein said keypad is mounted on an external surface of said portable computer to provide access to said keypad both when said portable computer is in said open position and when said portable computer is in said closed position.

13. The portable computer of claim 12 wherein said motion sensor generates said motion signal upon detection that said portable computer is rotated from said closed position to said open position.

14. The portable computer of claim 12 wherein said motion sensor generates said motion signal upon detection of said portable computer being moved.

15. The portable computer of claim 12 wherein said control circuit is responsive to a motion signal asserted on said motion signal line for asserting a siren enable signal on said siren enable signal line.

16. The portable computer of claim 15 wherein said siren is responsive to said siren enable signal to provide an audible tone.

17. The portable computer of claim 15 wherein said audible tone has a magnitude of approximately 110 decibels.

18. The portable computer of claim 12 wherein said alarm status indicator includes at least one light emitting diode.

19. The portable computer of claim 18 wherein said at least one light emitting diode is mounted on an external surface of said portable computer to provide access to said at least one light emitting diode when said portable computer is in either one of an open or closed position.

20. The portable computer of claim 12 further comprising:

a disable circuit coupled to said control circuit and a central processing unit of said portable computer, said disable circuit responsive to a disable signal from said control circuit for placing said central processing unit in an inoperable state.

21. The portable computer of claim 20 wherein said disable circuit is operable to write data into a non-volatile memory indicating unauthorized movement of said portable computer, said data to be read by said central processing during a boot procedure to prevent completion of said boot procedure when said data indicates said unauthorized movement.

22. A portable computer including an integrated alarm system, comprising:

a first case and a second case hingeably coupled such that said first and second cases may be positioned into one of an opened or a closed position where said open position results from rotating said first and second cases away from each other to reveal a display and controls of said portable computer and where said closed position results from rotating said first and second cases toward each other until said first and second cases are in contact with each other to conceal said display and said controls;

latching means for securing said first and second cases in said closed position, said latching means operable to allow said first and second cases to be placed in said open position;

status indicator means, said status indicator means providing an indication as to whether said alarm system is in an enabled state or a disabled state, said indicator means accessible both when said portable computer is in said open position and when said portable computer is in said closed position;

motion sensing means for providing a motion signal indicating when said latching means is operated to allow said first and second cases to be placed in said open position;

control means responsive to said motion signal for providing a siren signal to a siren means, said siren means responsive to said siren signal for producing an audible tone; and interface means coupled to said control means for enabling and disabling said alarm system, said interface means accessible when said portable computer is in both said open and said closed positions, said interface means contained substantially within either of said first or second cases.

23. The portable computer of claim 22 wherein said interface means comprises a keypad having a plurality of keys mounted to either of said first or second cases.

24. The portable computer of claim 22 wherein said indicating means includes at least one light emitting diode mounted to either of said first or second cases.

25. The portable computer of claim 22 wherein said audible tone has a magnitude of approximately 110 decibels.

26. The portable computer of claim 22 wherein said alarm system further includes power supply means, said power supply means providing operating voltages and currents to said sensing means, said control means, said indicating means, and said siren means.

27. The portable computer of claim 26 wherein said power supply means is separate from a power supply used to operate said portable computer.

28. The portable computer of claim 27 wherein said power supply means is the power supply used to operate said portable computer.

29. A portable computer including an integrated alarm system, comprising:

a first case and a second case hingeably coupled such that said first and second cases may be positioned into one of an opened or a closed position where said open position results from rotating said first and second cases away from each other to reveal a display and controls of said portable computer and where said closed position results from rotating said first and second cases toward each other until said first and second cases are in contact with each other to conceal said display and said controls;

latching means for securing said first and second cases in said closed position, said latching means operable to allow said first and second cases to be placed in said open position;

disable signal generating means, responsive to said latching means, for providing a disable signal indicating when said latching means is operated to allow said first and second cases to be placed in said open position; and disabling means, responsive to said disable signal, for disabling operation of said portable computer, said disabling including means for writing data to a memory, said data to be read by said computer system during a boot procedure such that if said data indicates unauthorized use, said boot procedure is halted thereby rendering said computer system inoperable.

30. A portable computer including an integrated alarm system, comprising:

a first case and a second case hingeably coupled such that said first and second cases may be positioned into one of an opened or a closed position where said open position results from rotating said first and second cases away from each other to reveal a display and controls of said portable computer and where said closed position results from rotating said first and second cases toward each other until said first and second cases are in contact with each other to conceal said display and said controls;

latching means for securing said first and second cases in said closed position, said latching means operable to allow said first and second cases to be placed in said open position;

disable signal generating means, responsive to said latching means, for providing a disable signal indicating when said latching means is operated to allow said first and second cases to be placed in said open position; and disabling means, responsive to said disable signal, for disabling operation of said portable computer, wherein said portable computer includes a central processing unit capable of being placed in a reset state by asserting a signal on a reset terminal of said central processing unit, and said disabling means including means for asserting and maintaining said signal on said reset terminal.

* * * * *